US007842139B2

(12) United States Patent
Peterson et al.

(10) Patent No.: US 7,842,139 B2
(45) **Date of Patent: *Nov. 30, 2010**

(54) EROSION RESISTANT CERMET LININGS FOR OIL AND GAS EXPLORATION, REFINING AND PETROCHEMICAL PROCESSING APPLICATIONS

(75) Inventors: John R. Peterson, Ashburn, VA (US); Narasimha-Rao V. Bangaru, Pittstown, NJ (US); Robert Lee Antram, Warrenton, VA (US); Christopher John Fowler, Houston, TX (US); Neeraj S. Thirumalai, Phillipsburg, NJ (US); ChangMin Chun, Belle Mead, NJ (US); Emery B. Lendvai-Lintner, Vienna, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1188 days.

This patent is subject to a terminal disclaimer.

(21) Appl. No.: 11/479,680

(22) Filed: Jun. 30, 2006

(65) Prior Publication Data

US 2008/0003125 A1 Jan. 3, 2008

(51) Int. Cl.
*C23C 30/00* (2006.01)

(52) U.S. Cl. ..... 148/279; 148/281; 148/519

(58) Field of Classification Search ..... 148/279, 148/525

See application file for complete search history.

(56) References Cited

U.S. PATENT DOCUMENTS 4,117,201 A 9/1978 Keifert (Continued)

FOREIGN PATENT DOCUMENTS

JP 01259117 A * 10/1986

(Continued)

OTHER PUBLICATIONS

U.S. Appl. No. 10/829,816, filed Apr. 22, 2004, Bangaru et al.

(Continued)

*Primary Examiner*—George Wyszomierski
(74) *Attorney, Agent, or Firm*—Robert A. Migliorini

(57) ABSTRACT

The present invention is directed to a method for protecting metal surfaces in oil & gas exploration and production, refinery and petrochemical process applications subject to solid particulate erosion at temperatures of up to 1000° C. The method includes the step of providing the metal surfaces in such applications with a hot erosion resistant cermet lining or insert, wherein the cermet lining or insert includes a) about 30 to about 95 vol % of a ceramic phase, and b) a metal binder phase, wherein the cermet lining or insert has a HEAT erosion resistance index of at least 5.0 and a $K_{1C}$ fracture toughness of at least 7.0 MPa-m$^{1/2}$. The metal surfaces may also be provided with a hot erosion resistant cermet coating having a HEAT erosion resistance index of at least 5.0. Advantages provided by the method include, inter alia, outstanding high temperature erosion and corrosion resistance in combination with outstanding fracture toughness, as well as outstanding thermal expansion compatibility to the base metal of process units. The method finds particular application for protecting process vessels, transfer lines and process piping, heat exchangers, cyclones, slide valve gates and guides, feed nozzles, aeration nozzles, thermo wells, valve bodies, internal risers, deflection shields, sand screen, and oil sand mining equipment.

28 Claims, 7 Drawing Sheets

Corrosion Resistance Versus Temperature of Prior Art TiC, FeCrAlY, Stainless Steel (SS) and WC-6Co In Comparison to $TiB_2$-SS Cermet of Present Invention (a) and SEM Images of Corrosion Layer Formed on WC-Co cermet and $TiB_2$-SS Cermet (b)

U.S. PATENT DOCUMENTS

| | | | | |
|---|---|---|---|---|
| 4,137,681 | A | 2/1979 | Pasley | |
| 4,753,053 | A | 6/1988 | Heard | |
| 5,427,987 | A * | 6/1995 | Mehrotra et al. | 501/96.3 |
| 6,129,967 | A | 10/2000 | Young et al. | |
| 6,261,346 | B1 | 7/2001 | Breuer et al. | |
| 6,571,889 | B2 * | 6/2003 | Griffo et al. | 175/371 |
| 7,074,253 | B2 | 7/2006 | Chun et al. | |
| 7,153,338 | B2 | 12/2006 | Parks | |
| 7,175,686 | B2 | 2/2007 | Chun et al. | |
| 7,175,687 | B2 | 2/2007 | Bangaru et al. | |
| 7,247,186 | B1 | 7/2007 | Chun et al. | |
| 7,288,132 | B2 | 10/2007 | Chun et al. | |
| 7,316,724 | B2 | 1/2008 | Bangaru et al. | |
| 2004/0231459 | A1 | 11/2004 | Chun et al. | |
| 2004/0231460 | A1 | 11/2004 | Chun et al. | |
| 2006/0137486 | A1 | 6/2006 | Bangaru et al. | |
| 2006/0156862 | A1 | 7/2006 | Chun et al. | |
| 2007/0128066 | A1 | 6/2007 | Chun et al. | |
| 2007/0227299 | A1 * | 10/2007 | Marchiando et al. | 75/244 |
| 2009/0018010 | A1 * | 1/2009 | Schrumpf et al. | 501/96.3 |

FOREIGN PATENT DOCUMENTS

| | | | |
|---|---|---|---|
| WO | WO 00/68615 | | 11/2000 |
| WO | WO 2004/104246 | A1 | 12/2004 |
| WO | WO 2004/104248 | A2 | 12/2004 |
| WO | WO 2004/104250 | A1 | 12/2004 |
| WO | WO 2004/104251 | A1 | 12/2004 |

OTHER PUBLICATIONS

U.S. Appl. No. 11/293,728, filed Dec. 2, 2005, Chun et al.
U.S. Appl. No. 10/829,820, filed Apr. 22, 2004, Chun et al.
U.S. Appl. No. 11/348,598, filed Feb. 7, 2006, Chun et al.
U.S. Appl. No. 10/829,822, filed Apr. 22, 2004, Chun et al.
U.S. Appl. No. 10/829,821, filed Apr. 22, 2004, Bangaru et al.
U.S. Appl. No. 10/829,824, filed Apr. 22, 2004, Chun et al.
U.S. Appl. No. 11/369,614, filed Mar. 7, 2006, Chun et al.
U.S. Appl. No. 10/829,823, filed Apr. 22, 2004, Bangaru et al.
U.S. Appl. No. 10/829,819, filed Apr. 22, 2004, Bangaru et al.
U.S. Appl. No. 10/829,818, filed Apr. 22, 2004, Chun et al.

* cited by examiner

Cross-Sectional View of Eroded Surface In a Refractory Showing Erosion Caused By Cracks Through The Binder Phase Corrosion Resistance Versus Temperature of Prior Art TiC, FeCrAlY, Stainless Steel (SS) and WC-6Co In Comparison to $TiB_2$–SS Cermet of Present Invention (a) and SEM Images of Corrosion Layer Formed on WC-Co cermet and $TiB_2$ -SS Cermet (b)

Hot Erosion/Attrition Tester (HEAT) Simulator Apparatus - Schematic (A) and Photo (B)

HEAT Erosion Index for Prior Art Materials and HER Cermet of the Present Invention Assembly of HER Cermet Tiles In The Form Of Pre-Assembled Tile Gangs (a) and Welding Of a Metal Anchor Onto a Metal Substrate (b)

Cyclone Liner Tile Integrity Performance of Prior Art Ceramic ($Si_3N_4$, SiC and alumina) Tiles [(a), (b), (c)] Versus HER Cermet Tiles (d) of Present Invention Fracture Toughness (MPa-m$^{1/2}$) As a Function of HEAT Erosion Index For Prior Art Materials In Comparison To HER Cermets Of The Present Invention

EROSION RESISTANT CERMET LININGS FOR OIL AND GAS EXPLORATION, REFINING AND PETROCHEMICAL PROCESSING APPLICATIONS

FIELD OF THE INVENTION

The present invention relates to cermet materials. It more particularly relates to the use of cermet materials in fluids and solids process applications requiring erosion resistance. Still more particularly, the present invention relates to the use of hot erosion resistant cermet linings and inserts requiring superior erosion/corrosion resistance, and fracture toughness for use in oil & gas exploration and production, refining and petrochemical processing applications.

BACKGROUND OF THE INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The combined properties of high temperature erosion resistance and toughness are required for linings and inserts used to provide long term erosion/abrasion resistance of internal metal surfaces in refining and petrochemical process units with operating temperatures above 600° F. The protection of these vessels and internals against erosion and corrosion induced material degradation especially at high temperatures is a technological challenge. Excellent erosion resistance is also required in certain oil & gas exploration and production equipment exposed to particularly abrasive materials, such as sand. Refractory liners are used currently for components requiring protection against the most severe erosion and corrosion such as the inside walls of internal cyclones used to separate solid particles from fluid streams, for instance, the internal cyclones in fluid catalytic cracking units (also referred to as "FCCU") for separating catalyst particles from the process fluid.

The state-of-the-art in erosion resistant materials is chemically bonded castable alumina refractories. The castable alumina refractories have adequate temperature and corrosion resistance, but limited erosion resistance. These castable alumina refractories are applied to the surfaces in need of protection and upon heat curing hardens and adheres to the surface via metal-anchors or metal-reinforcements. It also readily bonds to other refractory surfaces so as to provide either a patch or a full lining. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Exemplary solid particles are catalyst and coke. The primary erosion mechanism is cracking of the phosphate bond phase through the binder phase as shown in the cross sectional scanning electron micrograph of FIG. 1 depicting a prior art standard refractory sample used in the refinery and petrochemical process applications subjected to high temperature erosion under simulated FCCU service conditions. Cracks in the binder phase are clearly apparent in the micrograph. When these bonds are upgraded with stronger direct bonding of the ceramic grains, the overall lining becomes expensive to fabricate and prone to catastrophic, brittle fracture failures.

Thin layer ceramic coatings or weld overlays of precipitation hardened alloy may also be used for high temperature erosion resistance, but are less effective than conventional chemically bonded, castable refractory linings. Thickness and ceramic content are constrained in weld overlays and plasma sprayed coatings because the layer is applied in a molten form over a solid based metal and residual thermal/forming stresses are limiting.

Harder ceramic materials also tend to be too brittle and their lack of toughness adversely affects unit reliability. Metal rich ceramic-metal composites, such as hard facing, may alternatively be used but fall short of the level of erosion resistance provided by the aforementioned castables because forming/fabrication techniques limit the amount of hard, coarse grained ceramics available in the microstructure. Metal matrix composites with a higher content of hard ceramic grains have been designed with superior erosion resistance and toughness via powder metallurgy techniques for applications less than 600° F., but the current art does not provide compositions with temperature and corrosion resistance usable for advantage in refining and petrochemical process applications.

The limited hot erosion resistance of state-of-the-art ceramic rich, ceramic-metal composites such as WC bonded with Co or Ni cemented carbides is attributed to the lack the thermodynamic stability for long term, high temperature wear/erosion applications in corrosive environments. As depicted in FIG. 2, these materials are reactive with oxygen at FCCU temperatures when compared to more refractory steel and ceramic grains (TiC, SS, FeCrAlY). On the other hand, precipitation hardened alloys have a stable composition in high temperature process environments, but lack the high concentrations of hard ceramics and/or the shape and sizing of the these aggregates to optimize protecting the less wear resistant metal binding component from erosion.

Linings and inserts are used in numerous high temperature refining and petrochemical processes to protect internal steel surfaces from erosion/abrasion caused by circulating particulate solids such as catalyst or coke. One such application is cyclone separators. Over the past decade, significant advances in the cyclone design and refractory lining materials led to dramatic improvements in the operability and efficiency of FCCU units. At the same time, however, demands on the cyclone systems have been increasing due to commercial incentives for longer run lengths, higher throughput velocities, improved separation efficiency, and the use of harder, low attrition catalysts. Thus, high temperature erosion resistance and lining durability continue to be material properties limiting the reliability and run length of the FCCUs today and materials with an improved combination of durability and erosion resistance would offer enhancements in unit performance.

A need exists for linings, inserts and coatings for use in refining and petrochemical processing applications that have a combination of improved erosion/corrosion resistance at high temperatures compared to the state of the art refractory and excellent fracture toughness while still maintaining equivalent or better thickness and attachment reliability as the state of the art refractory. A need also exists for linings, inserts and coatings for use in oil & gas exploration and production that have improved erosion resistance when exposed to abrasive solid particle environments.

SUMMARY OF THE INVENTION

In one embodiment, the present invention provides an advantageous method for protecting metal surfaces in oil & gas exploration and production, refinery and petrochemical process applications subject to solid particulate erosion at temperatures of up to 1000° C., the method comprising the step of providing the metal surfaces with a hot erosion resistant cermet lining or insert, wherein the cermet lining or insert comprises: a) a ceramic phase, and b) a metal binder phase, and wherein the ceramic phase comprises from about 30 to about 95 vol % of the volume of the cermet lining or insert, and wherein the cermet lining or insert has a HEAT erosion resistance index of at least 5.0 and a $K_{1C}$ fracture toughness of at least 7.0 MPa-$m^{1/2}$.

In another embodiment, the present invention provides an advantageous method for protecting metal surfaces in oil & gas exploration and production, refinery and petrochemical process applications subject to solid particulate erosion at temperatures of up to 1000° C., the method comprising the step of providing the metal surfaces with a hot erosion resistant cermet coating, wherein the cermet coating comprises: a) a ceramic phase, and b) a metal binder phase, and wherein the ceramic phase comprises from about 30 to about 95 vol % of the volume of the cermet coating, and wherein the cermet coating has a HEAT erosion resistance index of at least about 5.0.

Numerous advantages result from the advantageous method for protecting metal surfaces in oil & gas exploration and production, refinery and petro-chemical process applications subject to solid particulate erosion with a cermet lining, insert or coating comprising: a) a ceramic phase, and b) a metal binder phase wherein the ceramic phase comprises from about 30 to about 95 vol % of the volume of the cermet lining, insert or coating and wherein the cermet lining, insert or coating has a HEAT erosion resistance index of at least 5.0 disclosed herein, and the uses/applications therefore.

An advantage of the method for protecting metal surfaces with a cermet lining, insert or coating of the present disclosure is that erosion resistance is improved in applications up to 1000° C.

Another advantage of the method for protecting metal surfaces with a cermet lining, insert or coating of the present disclosure is that it provides superior fracture toughness in the erosion resistant lining, insert or coating.

Another advantage of the method for protecting metal surfaces with a cermet lining, insert or coating of the present disclosure is that corrosion resistance is improved or not compromised.

Another advantage of the method for protecting metal surfaces with a cermet lining, insert or coating of the present disclosure is that outstanding hardness is exhibited.

Another advantage of the method for protecting metal surfaces with a cermet lining, insert or coating of the present disclosure is that excellent stability at high temperatures from thermal degradation in the cermet microstructure is exhibited, thus making the method highly desirable and unique for long term service in high temperature refinery and petrochemical process applications.

Another advantage of the method for protecting metal surfaces with a cermet lining, insert or coating of the present disclosure is that excellent erosion resistance to sand and other abrasive particulars is exhibited, thus making the method desirable for oil & gas exploration and production applications.

Still yet another advantage of the method for protecting metal surfaces with a cermet lining, insert or coating of the present disclosure is that outstanding thermal expansion compatibility to various substrate metals is exhibited.

Still yet another advantage of the method for protecting metal surfaces with a cermet lining, insert or coating of the present disclosure is that tiles for linings may be formed via powder metallurgy processing and attached to metal substrates via welding techniques.

Still yet another advantage of the method for protecting metal surfaces with a cermet lining, insert or coating of the present disclosure is that coatings may be formed via thermal spray processing on the metal surfaces to be protected.

These and other advantages, features and attributes of the method for protecting metal surfaces with a cermet lining, insert or coating of the present disclosure and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION OF THE INVENTION

Figure 1:
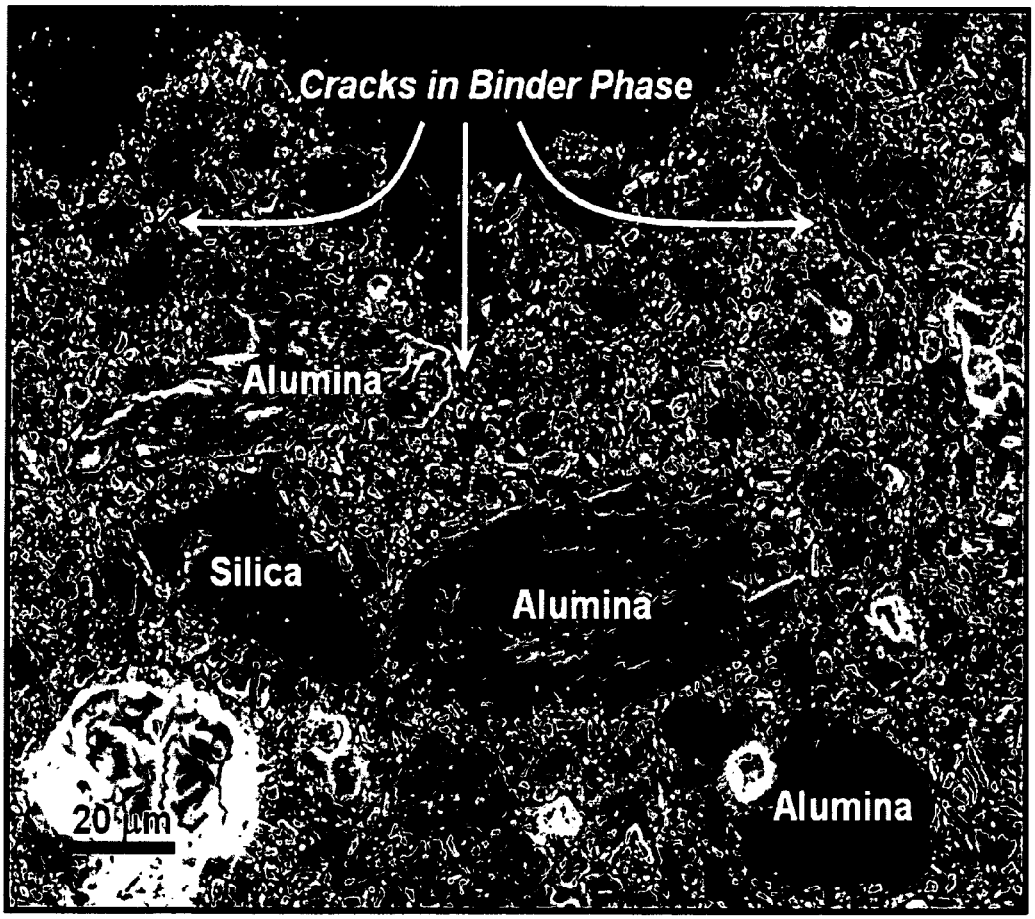
FIGURE 1 (Prior Art)
FIG. 1 depicts a cross-section of the eroded surface in a prior art refractory showing erosion caused by cracks through the binder phase.

The present invention includes a method for reducing solid particulate erosion in oil & gas exploration and production, refining and petrochemical processing applications comprising adhering hot erosion resistant (also referred to as "HER") cermet linings, inserts or coatings onto the inner or outer surfaces of oil & gas exploration and production, refining and petrochemical process equipment to form a lining subjected to solid particulate erosion, wherein the HER cermet linings, inserts or coatings comprise a ceramic phase and a metal binder phase. The method for reducing solid particulate erosion in oil & gas exploration and production, refining and petrochemical processing applications are distinguishable from the prior art in comprising novel and unobvious linings, inserts or coatings compositions that yield not only a unique combination of superior erosion/corrosion resistance and fracture toughness, but also excellent fabricability, and thermal expansion compatibility to base metals.

Cyclone experience proves the usefulness of castable linings requires a combination of erosion resistant and toughness properties. While some of the advanced engineering ceramics have been known to have superior erosion resistance, direct bonding between the hard ceramic grains causes the materials to become adversely brittle. Hard ceramics used in high temperature lining applications are prone to thermal stress damage by one of two mechanisms. If they have a high thermal expansion coefficient, thermal stress alone is sufficient to fracture the component. With a lower thermal expansion coefficient, these stresses are reduced, but the thermal expansion mismatch between cyclone body and the lining components is increased. This allows catalyst or coke to fill in cracks and gaps that form when the lining is hot. When cooled, the ingressed catalyst prevents contraction and stresses the lining components to a level that makes the components prone to failure. Furthermore, normal temperature fluctuations can induce thermal fatigue and shut-down and heat-up cycles can further induce stresses making the component fail if sufficient fracture toughness is not available in the materials used for fabrication. Thus, superior fracture toughness is needed to enhance cyclone liner tile integrity and to suppress thermal stress damage.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a metal binder phase and are commonly produced using powder metallurgy techniques where metal and ceramic powders are mixed, pressed and sintered at high temperatures to form dense compacts. Hot erosion resistant cermets of the present invention are intended for high temperature and standard temperature applications and have common features of constituent materials, fabrication, microstructural design and resulting optimized physical properties that set them apart from the current art in the subject use applications. The range of HER cermets suitable for oil & gas exploration and production, refining and petrochemical processes of the current invention comprise generally a ceramic phase and a metal binder phase having a unique combination of erosion resistance and fracture toughness, wherein the compositions of these phases are described in greater detail below.

Co-pending U.S. patent application Ser. No. 10/829,816 filed on Apr. 22, 2004 to Bangaru et al. discloses boride cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Group IV, Group V, Group VI elements, Q is boride, R is selected from the group consisting of Fe, Ni, Co, Mn and mixtures thereof, and S comprises at least one element selected from Cr, Al, Si and Y. The ceramic phase disclosed is in the form of a monomodal grit distribution. U.S. patent application Ser. No. 10/829,816 is incorporated herein by reference in its entirety.

Co-pending U.S. patent application Ser. No. 11/293,728 filed on Dec. 2, 2005 to Chun et al. discloses boride cermet compositions having a bimodal and multimodal grit distribution with improved erosion and corrosion resistance under high temperature conditions, and a method of making thereof. The multimodal cermet compositions include a) a ceramic phase and b) a metal binder phase, wherein the ceramic phase is a metal boride with a multimodal distribution of particles, wherein at least one metal is selected from the group consisting of Group IV, Group V, Group VI elements of the Long Form of The Periodic Table of Elements and mixtures thereof, and wherein the metal binder phase comprises at least one first element selected from the group consisting of Fe, Ni, Co, Mn and mixtures thereof, and at least second element selected from the group consisting of Cr, Al, Si and Y, and Ti. The method of making multi-modal boride cermets includes the steps of mixing multimodal ceramic phase particles and metal phase particles, milling the ceramic and metal phase particles, uniaxially and optionally isostatically pressing the particles, liquid phase sintering of the compressed mixture at elevated temperatures, and finally cooling the multimodal cermet composition. U.S. patent application Ser. No. 11/293,728 is incorporated herein by reference in its entirety.

Co-pending U.S. patent application Ser. No. 10/829,820 filed on Apr. 22, 2004, and Ser. No. 11/348,598 filed on Feb. 7, 2006 to Chun et al. disclose carbonitride cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Ti, Zr, Hf, V, Nb, Ta, Cr, Mo, W, Fe, Mn and mixtures thereof, Q is carbonitride, R is a metal selected from the group consisting of Fe, Ni, Co, Mn and mixtures thereof, and S comprises at least one element selected from Cr, Al, Si and Y. U.S. patent application Ser. Nos. 10/829,820 and 11/348,598 are incorporated herein by reference in their entirety.

Co-pending U.S. patent application Ser. No. 10/829,822 filed on Apr. 22, 2004 to Chun et al. discloses nitride cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Si, Mn, Fe, Ti, Zr, Hf, V, Nb, Ta, Cr, Mo, W and mixtures thereof, Q is nitride, R is a metal selected from the group consisting of Fe, Ni, Co, Mn and mixtures thereof, S consists essentially of at least one element selected from Cr, Al, Si, and Y, and at least one reactive wetting aliovalent element selected from the group consisting of Ti, Zr, Hf, V, Nb, Ta, Cr, Mo, W and mixtures thereof. U.S. patent application Ser. No. 10/829,822 is incorporated herein by reference in its entirety.

Co-pending U.S. patent application Ser. No. 10/829,821 filed on Apr. 22, 2004 to Bangaru et al. discloses oxide cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Al, Si, Mg, Ca, Y, Fe, Mn, Group IV, Group V, Group VI elements, and mixtures thereof, Q is oxide, R is a base metal selected from the group consisting of Fe, Ni Co, Mn and mixtures thereof, S consists essentially of at least one element selected from Cr, Al and Si and at least one reactive wetting element selected from the group consisting of Ti, Zr, Hf, Ta, Sc, Y, La, and Ce. U.S. patent application Ser. No. 10/829,821 is incorporated herein by reference in its entirety.

Co-pending U.S. patent application Ser. No. 10/829,824 filed on Apr. 22, 2004, and Ser. No. 11/369,614 filed on Mar. 7, 2006 to Chun et al. disclose carbide cermet compositions with a reprecipitated metal carbide phase with improved erosion and corrosion resistance under high temperature conditions, and a method of making thereof. The improved cermet composition is represented by the formula (PQ)(RS) G where (PQ) is a ceramic phase; (RS) is a binder phase; and G is reprecipitate phase; and wherein (PQ) and G are dispersed in (RS), the composition comprising: (a) about 30 vol % to 95 vol % of (PQ) ceramic phase, at least 50 vol % of said ceramic phase is a carbide of a metal selected from the group consisting of Si, Ti, Zr, Hf; V, Nb, Ta, Mo and mixtures thereof; (b) about 0.1 vol % to about 10 vol % of 6 reprecipitate phase, based on the total volume of the cermet composition, of a metal carbide MXCY where M is Cr, Fe, Ni, Co, Si, Ti, Zr, Hf, V, Nb, Ta, Mo or mixtures thereof; C is carbon, and x and y are whole or fractional numerical values with x ranging from 1 to about 30 and y from 1 to about 6; and (c) the remainder volume percent comprises a binder phase, (RS), where R is a metal selected from the group consisting of Fe, Ni, Co, Mn and mixtures thereof, and S, based on the total weight of the binder, comprises at least 12 wt % Cr and up to about 35 wt % of an element selected from the group consisting of Al, Si, Y, and mixtures thereof. U.S. patent application Ser. Nos. 10/829,824 and 11/369,614 are incorporated herein by reference in their entirety.

Co-pending U.S. patent application Ser. No. 10/829,823 filed on Apr. 22, 2004 to Bangaru et al. discloses carbide cermet compositions with improved erosion and corrosion resistance under high temperature conditions, and a method of making thereof. The improved cermet composition comprises (a) about 50 vol % to about 95 vol %, based on the total volume of the cermet composition, of a ceramic phase, wherein the ceramic phase being a chromium carbide selected from the group consisting of $Cr_{23}C_6$, $Cr_7C_3$, $Cr_3C_2$ and mixtures thereof; and (b) a binder phase selected from the group consisting of (i) alloys containing, based on the total weight of the alloy, about 60 wt % to about 98 wt % Ni; about 2 wt % to about 35 wt % Cr; and up to about 5 wt % of an element selected from the group consisting Al, Si, Mn, Ti and mixtures thereof; and (ii) alloys containing about 0.01 wt % to about 35 wt % Fe; about 25 wt % to about 97.99 wt % Ni, about 2 wt % to about 35 wt % Cr; and up to about 5 wt % of an element selected from the group consisting of Al, Si, Mn, Ti and mixtures thereof. U.S. patent application Ser. No. 10/829,823 is incorporated herein by reference in its entirety.

Co-pending U.S. patent application Ser. No. 10/829,819 filed on Apr. 22, 2004 to Bangaru et al. also discloses cermet compositions with improved erosion and corrosion resistance under high temperature conditions, and a method of making thereof. The improved cermet composition is represented by the formula (PQ)(RS)X comprising: a ceramic phase (PQ), a binder phase (RS) and X wherein X is at least one member selected from the group consisting of an oxide dispersoid E, an intermetallic compound F and a derivative compound G wherein said ceramic phase (PQ) is dispersed in the binder phase (RS) as particles of diameter in the range of about 0.5 to 3000 microns, and said X is dispersed in the binder phase (RS) as particles in the size range of about 1 nm to 400 nm. U.S. patent application Ser. No. 10/829,819 is incorporated herein by reference in its entirety.

Co-pending U.S. patent application Ser. No. 10/829,818 filed on Apr. 22, 2004 to Chun et al. also discloses composition gradient cermets and reactive heat treatment processes for producing the same to yield compositions with improved erosion and corrosion resistance under high temperature conditions The process for preparing a composition gradient cermet material comprises the steps of: (a) heating a metal alloy containing at least one of chromium and titanium at a temperature in the range of about 600° C. to about 1150° C. to form a heated metal alloy; (b) exposing the heated metal alloy to a reactive environment comprising at least one member selected from the group consisting of reactive carbon, reactive nitrogen, reactive boron, reactive oxygen and mixtures thereof in the range of about 600° C. to about 1150° C. for a time sufficient to provide a reacted alloy; and (c) cooling the reacted alloy to a temperature below about 40° C. to provide a composition gradient cermet material. U.S. patent application Ser. No. 10/829,818 is incorporated herein by reference in its entirety.

The present invention relates to the advantageous use of the hot erosion resistant cermet compositions of the co-pending U.S. patent applications referenced above and incorporated by reference in their entirety as ceramic-metal composite linings and inserts in oil & gas exploration and production, refining and petrochemical process units to provide long term erosion/abrasion resistance. For refining and petrochemical process units, the method of providing cermet linings, inserts and coatings is particularly advantageous for units operating at temperatures in excess 600° F. The use of these HER cermet compositions is advantageous because of the novel combination of properties (erosion resistance and fracture toughness), composition, fabrication and design features which are not available in the current state-of-the-art castable refractories, cermets, coatings or weld overlays. With these features, the referenced cermet composite materials may be used as a lining, insert or coating to provide a superior level of erosion protection to process internals and drilling, exploration and production equipment exposed to abrasive particulate, such as for example catalyst, coke, sand, etc. An insert is distinguished from a lining as typically being one-piece that is positioned within the metal surface to be protected. An insert may be, but is not limited to, cylindrical or tubular shapes. Insert and linings are differentiated from coatings in terms of thickness. Inserts and linings are generally 5 mm and greater in thickness, whereas coatings are generally 5 mm and less in thickness.

The HER cermets referenced above have common features making for their advantageous use in oil & gas exploration and production, refining and petrochemical process units. These enabling features include, but are not limited to, the following: 1) composition or surface coating of aggregate to facilitate wetting of the binder metal, 2) compositional components with little or no reactivity in the FCCU process environment, 3) ceramic grain population and sizing to protect the relatively soft binder from particle contact, 4) high toughness resulting from the ductility and crack blunting of the binder, and 5) tile shape formability to facilitate fabrication for optimum erosion resistance and attachment reliability.

Figure 2:
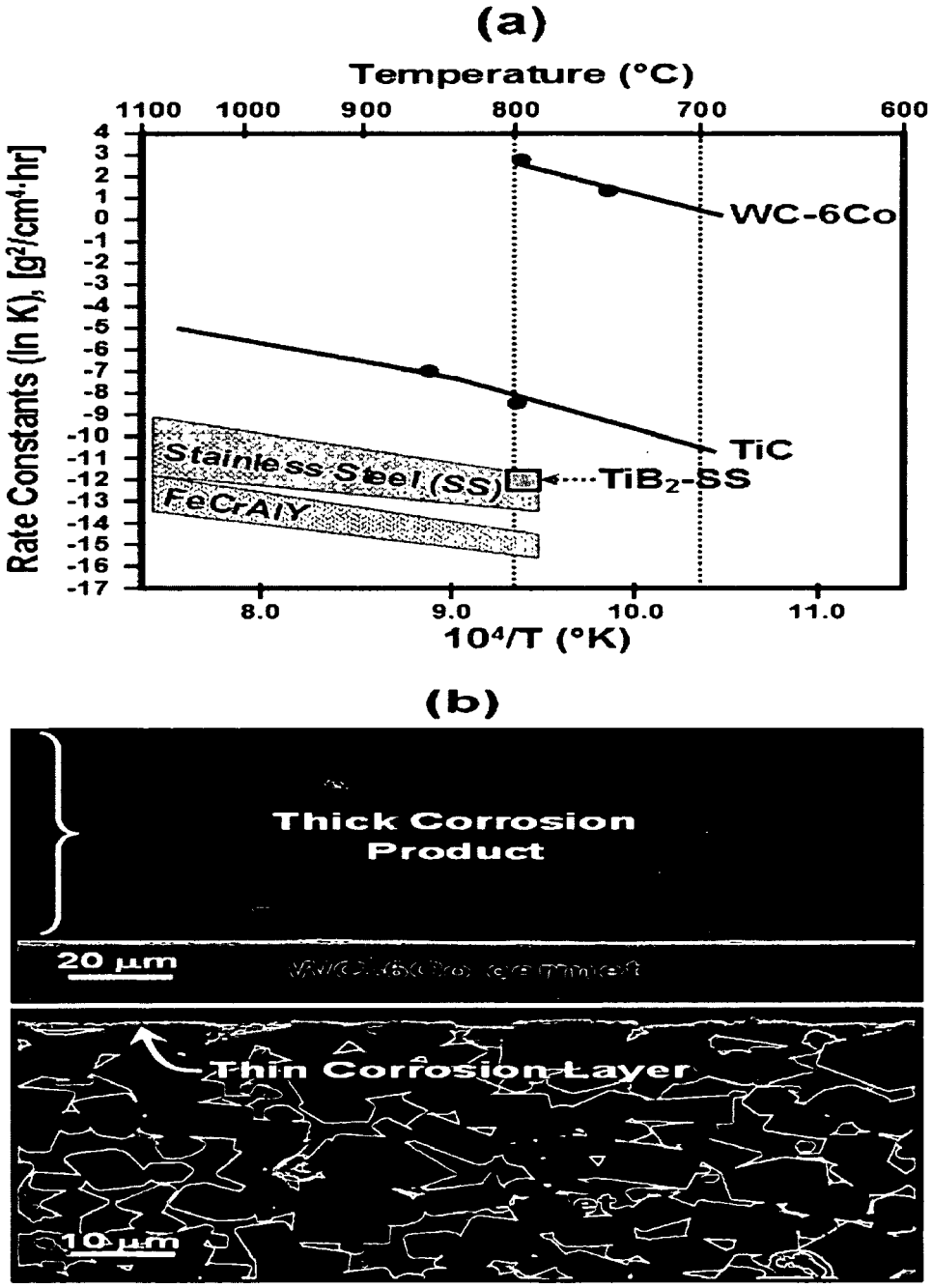
FIG. 2 depicts a plot (a) of the corrosion resistance of various prior art materials, including TiC, FeCrAlY, Stainless Steel (SS), and WC-6Co, as a function of temperature in comparison to a $TiB_2$-SS cermet of the present invention and SEM images (b) of the corrosion layer formed on the prior art WC-Co cermet and the $TiB_2$-SS cermet of the present invention.

The HER cermets of the present invention provide for superior state-of-the-art lining materials. FIG. 2(*a*) depicts a comparison of the corrosion resistance of various prior art materials, including TiC, FeCrAlY, Stainless Steel (SS), and WC-6Co, as a function of temperature in comparison to a $TiB_2$-SS cermet of the present invention. This figure is a typical Arrhenius plot and shows the parabolic rate constant (K) in a log scale on the y-axis plotted against inverse temperature. The parabolic rate constant has been used as a measure of corrosion resistance. The lower the value of the rate constant the higher the corrosion resistance. The corrosion property target for the erosion resistant cermet lining of the present invention is to have a corrosion resistance equal to that of stainless steel. It can be seen that the prior art WC based cermets and TiC have very high corrosion rate while the $TiB_2$-SS cermets can meet the corrosion target. FIG. 2(*b*) depicts SEM images of the corrosion layer formed from FIG. 2(*a*) on the prior art WC-Co cermet (top of FIG. 2(*b*)) and $TiB_2$ in stainless steel binder cermet of the present invention (bottom of FIG. 2(*b*)) after air oxidation for 65 hours. The prior art WC-6Co cermet is chemically unstable at high temperature oxidizing environments producing break away corrosion and a non-protective, very thick corrosion scale compared to the protective, thin corrosion layer of the $TiB_2$-SS cermet of the present invention.

Figure 3:
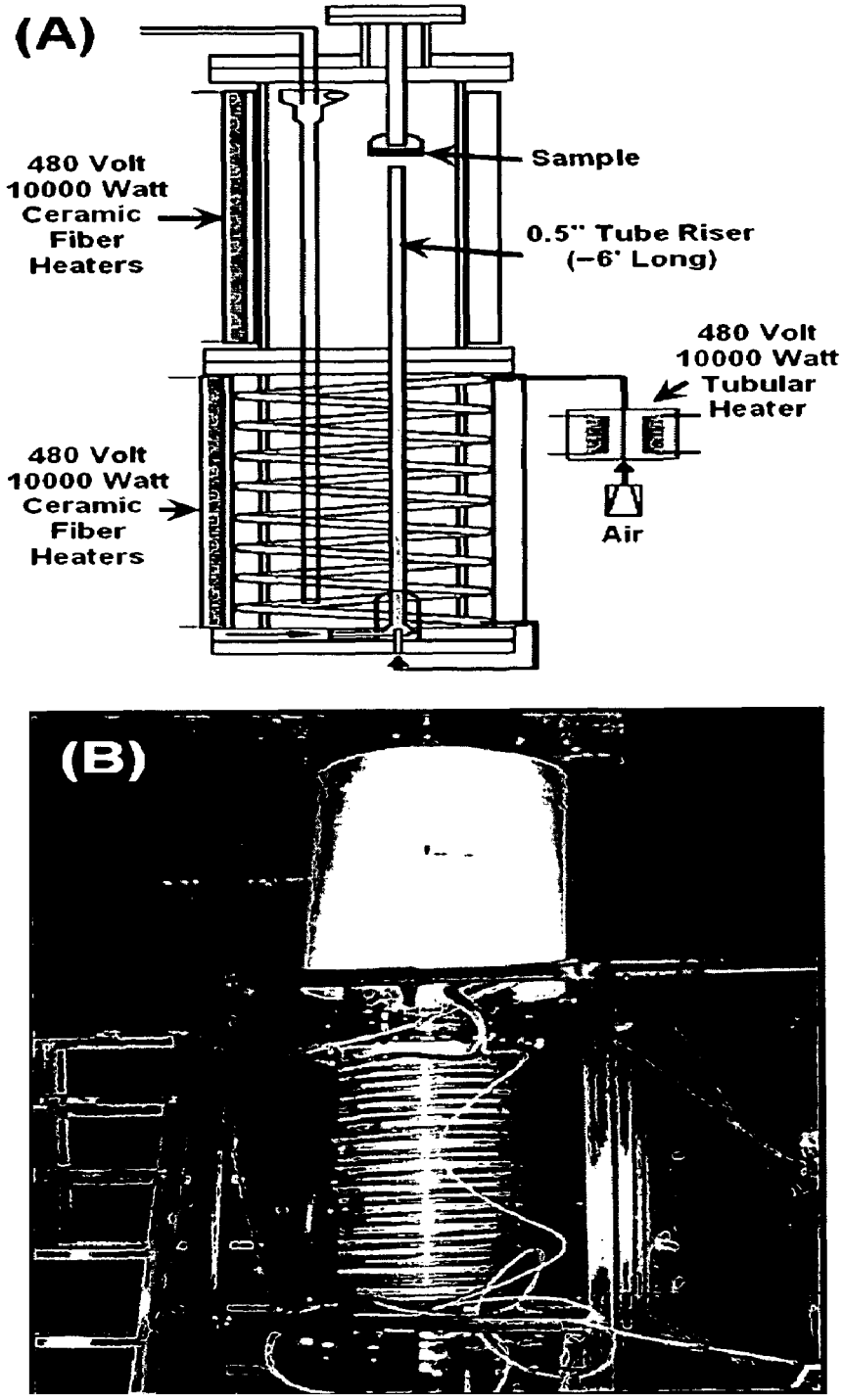
FIG. 3 depicts a schematic (a) and an actual photo (b) of the hot erosion/attrition testing (HEAT) apparatus of the present invention.

HEAT Test Simulator Apparatus and Test Procedure:

A material's inherent resistance to erosion when exposed to moving solid particulates striking the surface of the material is termed its erosion resistance. The applicants have developed a test for measuring the erosion resistance of materials that simulates the environment encountered under FCCU service. The test is referred to as HEAT (Hot Erosion/Attrition Testing) and yields a HEAT erosion resistance index as a measure of material performance when subjected to hot and abrasive particulate matter. The higher the HEAT erosion resistance index, the better the erosion resistance performance of the material. FIG. 3(*a*) depicts a schematic of the HEAT tester with its various parts and FIG. 3(*b*) depicts a photograph of the actual tester. The HEAT erosion resistance index is determined by measuring the erosion index by determining the volume of test material lost in a given duration as compared to a refractory standard tested at the same conditions for the same duration of time. The velocity range of the test simulator is 10 to 300 ft/sec (3.05 to 91.4 m/sec) which covers the velocity range in a FCCU. The test temperature is variable and may be up to 1450° F. (788° C.). The test angle of impingement is from 1 to 90 degrees. The mass flux may range from 1.10 to 4.41 lbm/minute. The test environment may be in air or a controlled atmosphere (mixed gas). The test simulator may also provide for long duration erosion tests with a re-circulated erodent. Superior hot erosion resistance of the HER cermet linings of the present invention has been substantiated by hot erosion test results using the HEAT test simulator apparatus depicted in FIG. 3.

The attrition behavior and erosivity of catalyst and coke particles affect many processing units where the particles are circulated at elevated temperatures. The apparatus was designed to simulate operating conditions of those processes. Simulated conditions include velocity, loading and angle of impingement in a controlled temperature and gas composition environment. Determining features of the apparatus provide for testing of particulate and/or containing lining materials under a wide range of conditions in a controlled and reproducible manner usable for performance evaluations. Applications for this data include but, are not limited to, cyclone separators and transfer lines in petrochemical processes such as Fluidized Catalytic Cracking Units.

The subject test apparatus facilitates a recycling of hot erodent to address the characteristically long life cycle of particulate catalysts and erosion resistant linings in real industrial applications while retaining practical laboratory features. The apparatus allows for the testing of actual abrading and lining materials permitting evaluations of both erodant and sample materials under conditions more closely duplicating those of the industrial operating environment. Features of the apparatus make those conditions self-sustaining for a long enough period of time that measurable changes in erosion and/or attrition can be made for the variable of interest to service performance and reliability. This improves on current tests such as the ASTM C704 standard abrasion test which is done at room temperature using high velocity, high erodant concentrations, and a single pass of artificially erosive particulate over short test duration.

Specific examples of this design are shown, but not limited, to FIG. 3(*a*). Key features of the apparatus are a straight vertical riser tube where solids particles are accelerated using preheated gas and projected at a sample material housed within an enclosure with a single vent outlet. This enclosure provides for a dropout of the major portion of the solids from exhausting gas before it reaches the outlet line. In this way, the outlet line can further be equipped with additional solids recovery such as a cyclone separator with all recovered solids collected in the bottom of the enclosure by gravity. Collected solids thus accumulated are then heated and/or fluidized as needed to be reintroduced back into the orifice or mechanical feed system for the vertical riser to repeat the cycle. Solids make-up for volume and/or particle size is made by incremental additions into the inventory of the enclosure.

The test apparatus can operate from room temperature to about 1450° F. (788° C.) with solids concentrations from 0 to 5 lb/ft$^3$ for particles from 5 to 800 microns at velocities of 10 to 300 ft/sec (3.05 to 91.44 m/sec) using air or premixed gaseous components. The design provides for a hot change out of particulate, worn riser tube and/or eroding sample without the need to cool down and reheat the entire test apparatus. Other features include ability to test at a range of impact angles from 1 to 90° and suitable instrumentation to monitor and control erodant, temperature and gas environment for test duration measured in seconds, minutes, hours, days, months or years. Instrument options include: an opacity meter or differential pressure gauge to determine the flow concentration, and rate controlled orifice or screw feeder to maintain steady addition of solids into the riser flow, thermocouples mounted in key temperature areas; along with pressure and velocity indicators and a sampling port from the inventory solids for measurement of particle size distribution.

FIG. 3(*b*) depicts the as-built HEAT simulator apparatus. Several different types of instrumentation are included for control of the apparatus. For example, a differential pressure transducer is used for monitoring and insuring the continual flow of erodant. In addition, thermocouples are mounted in key areas of the apparatus to monitor temperature.

Each of the cermets was subjected to a hot erosion and attrition test (HEAT) using the apparatus depicted in FIG. 3. The test procedure utilized is as follows:

1) A specimen cermet tile part of about 42 mm length, about 28 mm width, and about 15 mm thickness is weighed.

2) The center of one side of the part is then subjected to 1200 g/min of SiC particles (220 grit, #1 Grade Black Silicon Carbide, UK abrasives, Northbrook, Ill.) entrained in heated air exiting from a tube with a 0.5 inch diameter ending at 1 inch from the target at an angle of 45°. The velocity of the SiC is 45.7 m/sec.

3) Step (2) is conducted for 7 hours at 732° C.

4) After 7 hours the specimen is allowed to cool to ambient temperature and weighed to determine the weight loss.

5) The erosion of a specimen of a commercially available castable refractory is determined and used as a Reference Standard. The Reference Standard erosion is given a value of 1 and the results for the cermet specimens are compared to the Reference Standard.

6) The volume loss of a specimen and the Reference Standard after HEAT testing is directly measured by 3-dimensional laser profilometry to confirm the data from the weight loss measurement.

Fracture Toughness Test Procedure:

The $K_{1C}$ fracture toughness of the present invention is a measure of the resistance of the material to failure after crack initiation. The higher the $K_{1C}$ fracture toughness, the greater the toughness of the material. Fracture toughness ($K_{1C}$) of HER cermets is measured by using 3-point bend testing of single edge notched beam (SENB) specimens. The measurement is based on ASTM E399 standard test method under predominantly linear-elastic, plane-strain conditions. Details of test procedures utilized are as follows:

Specimen Dimensions and Preparations: Three specimens are machined from a sintered HER cermet tile using a wire Electric Discharge Machining (EDM) or a diamond saw and ground to 600 grit diamond finish to the following dimensions: width (W)=8.50 mm, thickness (B)=4.25 mm (W/B=2) and length (L)=38 mm. The machined specimens are notched from the edge using 0.15 mm (0.006 in) thick diamond wafering blade (e.g. Buehler, Cat No: 11-4243) in a diamond saw (e.g. Buehler Isomet 4000). The notch depth (a) is such that the a/W ratio is between 0.45 and 0.5

Test Methodology: The specimens are loaded in 3 point bending with a span (S) of 25.4 mm (S/W ratio of 3) in a universal testing machine (e.g. MTS 55 kips frame with an Instron 8500 controller) equipped with a 500, 1000 or 2000 lb load cell. The displacement rate during testing is about 0.005 in/min. The specimen is loaded to failure and the load versus displacement data is recorded in a computer with sufficient resolution to capture all fracture events.

Calculation of $K_{1C}$: The peak load at failure is measured and used to calculate the fracture toughness using a following equation.

$$K_{IC} = \left(\frac{PS}{BW^{\frac{3}{2}}}\right) * f\left(\frac{a}{w}\right)$$

where:

$$f\left(\frac{a}{w}\right) = \frac{3\sqrt{\frac{a}{w}}\left[1.99 - \left(\frac{a}{w}\right)\left(1 - \frac{a}{w}\right)\left\{2.15 - 3.93\left(\frac{a}{w}\right) + 2.7\left(\frac{a}{w}\right)^2\right\}\right]}{2\left(1 + 2\left(\frac{a}{w}\right)\right)\left(1 - \frac{a}{w}\right)^{\frac{3}{2}}}$$

where:

$K_{1C}$ is in MPa·m$^{1/2}$

P=load (kN)

B=specimen thickness (cm)

S=span (cm)

W=specimen width (cm)

a=crack/notch length (cm)

Figure 4:
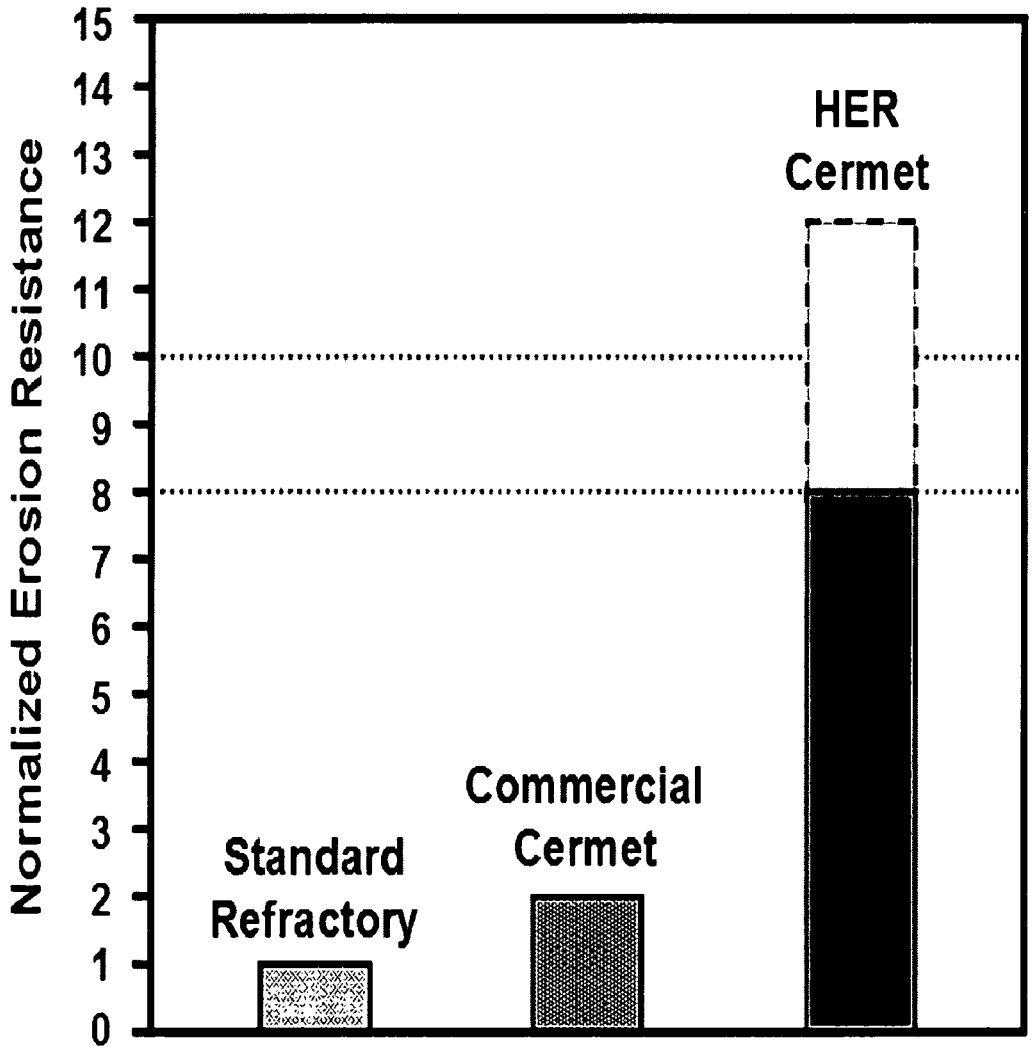
FIG. 4 depicts a bar graph of the HEAT erosion index for a prior art standard refractory and a prior art commercial cermet material in comparison to the HER cermets of the present invention.

FIG. 4 is a plot of the HEAT erosion resistance index of the HER cermet materials of the present invention in comparison to a prior art standard refractory material (phosphate bonded castable refractory) and a prior art commercial cermet (TiC cermet with 28 vol % metal binder, wherein the metal is 37.5% Co, 37.5% Ni and 25.0% Cr in wt %). The one experimental and two prior art materials were exposed to SiC particulates for 7 hours at 730° C. The HER cermet linings of the present invention exhibit no cracking or preferential erosion in the binder phase and have a HEAT erosion resistance index of 8 to 12 times greater than the refractory standard (erosion resistance of <3 cc as measured by ASTM C704). The metal binder in HER cermets also displays advantageous toughness and crack blunting when sectioned and viewed along an eroded surface. Additionally, it has been shown that such composite micro-structures can be practically fabricated by powder metallurgy or fuision bonding of metal alloys thermodynamically stable at elevated temperatures. Undesirable effects of poor wetting and/or over-reactivity may be overcome via surface coating and/or fabrication techniques.

In one embodiment, the HER cermets of the present invention may be provided on the surfaces of oil & gas exploration and production, refinery and petrochemical process equipment in the form of linings or inserts where an outstanding combination of erosion resistance and fracture toughness are advantageous. In an alternative embodiment, the HER cermets of the present invention may be provided on the surfaces of oil & gas, refinery and petro-chemical process equipment in the form of coatings where outstanding erosion resistance is advantageous.

HER cermet linings of the present invention are formed from tiles that are assembled and welded onto a metal substrate surface to form a lining. HER cermet tiles are typically formed via powder metallurgy processing wherein metal and ceramic powders are mixed, pressed and sintered at high temperatures to form dense compacts. More particularly, a ceramic powder is mixed with a metal binder in the presence of an organic liquid and a paraffin wax to form a flowable powder mix. The ceramic powder and metal powder mixture is placed into a die set where it is uniaxially pressed to form a uniaxially pressed green body. The uniaxially pressed green body is then heated through a time-temperature profile to effectuate burn out of the paraffin wax and liquid phase sintering of the uniaxially pressed green bodies to form a sintered HER cermet composition. The sintered HER cermet composition is then cooled to a form a HER cermet composition tile which may be affixed to the metal surface to be protected to form a protective lining or insert. The tiles range in thickness from 5 mm to 100 mm, preferably from 5 mm to 50 mm, and more preferably from 5 mm to 25 mm. The tiles range in size from 10 mm to 200 mm, preferably from 10 mm to 100 mm, and more preferably from 10 mm to 50 mm. The tiles may be made into a variety of shapes including, but not limited to, squares, rectangles, triangles, hexagons, octagons, pentagons, parallelograms, rhombus, circles and ellipses.

Figure 5:
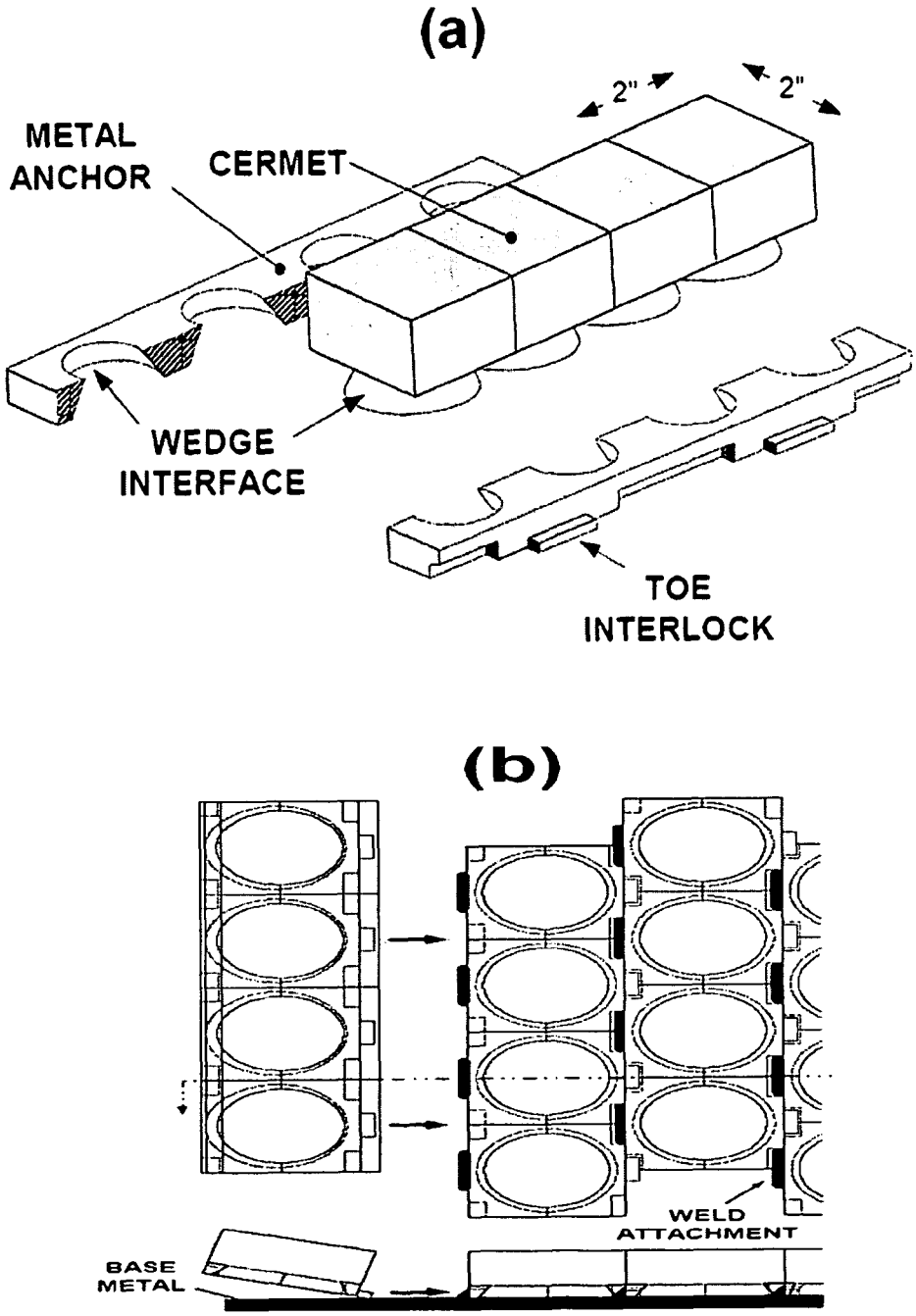
FIG. 5 depicts a schematic of an assembly of cermet tiles of the present invention in the form of pre-assembled tile gangs (a) and welding of a metal anchor onto a metal substrate (b).

HER cermet tiles of the present invention may be made in a size comparable to refractory biscuits in hexmetal using a ganged design as illustrated in FIGS. 5(*a*) and (*b*). These features of the present invention allow for the coverage of flat and curved surfaces with minimal specialty shapes using weld on attachment of the anchor holding the tile that is practical for initial installation and repair when used in combination with conventional refractory or in place of it. The welded metal anchor of the pre-assembled tile gangs of FIG. 5(*a*) of the present invention in comparison to hexmetal anchored systems have approximately four times the bearing surface to volume ratio, four times the retention strength and reduced thermal expansion mismatch to the base metal for anchoring. In particular, regarding the reduced thermal expansion mismatch, the HER cermet tiles of the present invention have virtually no thermal expansion mismatch with a base carbon steel, and a reduction of 50% in thermal expansion mismatch with a base of stainless steel.

The HER cermet compositions of the present invention may also be coated on the surfaces of oil & gas exploration and production, refining and petrochemical process equipment. Coating provides for a much reduced thickness compared to tiles and typically in the range from 1 micron to 5000 microns, preferably from 5 microns to 1000 microns, and more preferably from 10 microns to 500 microns. HER cermet compositions of the present invention for use as protective coating in oil & gas exploration and production, refinery and petrochemical process equipment may be formed by any of the following thermal spray coating processes, including, but not limited to, plasma spray, combustion spray, arc spray, flame spray, high-velocity oxyfuel (HVOF) and detonation gun (D-gun).

The HER cermet linings, inserts and coatings used in refining and petrochemical processing units achieve, inter alia, outstanding high temperature erosion and corrosion resistance in combination with outstanding fracture toughness, as well as outstanding thermal expansion compatibility to the base metal of such process units. Further advantages of the HER cermet linings of the present invention in comparison to hard facing weld overlays or ceramic coatings for refinery and petrochemical processes include, but are not limited to, the possibility of greater thickness and the elimination of the dependence on adhesion or fusion bonding. Another advantage is the ability to fabricate into tiles the HER cermets of the present invention separate from the base metal for attachment, and then subsequently attaching via metallic anchors the HER cermet tiles onto the inner surfaces of refinery and petrochemical process equipment to form a lining.

The HER cermet linings, inserts and coatings of the present invention are suitable for many areas in refining and petrochemical processing units with temperatures in excess of 600° F. (316° C.) where a highly reliable lining with superior erosion resistance is desirable. In one embodiment, the HER cermet linings of the present invention may be used in areas of Fluid Catalytic Conversion Units (FCCU) of a refinery. In an alternative embodiment, the HER cermet linings of the present invention may be used in areas of Fluid Cokers and flexicoking (also referred to as flexicokers) of a refinery. In another embodiment, the HER cermet linings of the present invention may be used in petrochemical process equipment. More specifically, the areas of refinery and petrochemical process equipment that are advantageously provided with the HER cermet linings, inserts and coatings of the present invention include, but are not limited to, process vessels, transfer lines and process piping, heat exchangers, cyclones, slide valve gates and guides, feed nozzles, aeration nozzles, thermo wells, valve bodies, internal risers, deflection shields and combinations thereof. Similar applications are seen in other fluids-solids applications, such as Gas to Olefin and Fluid Bed Syngas Generation.

The HER cermet linings, inserts and coatings of the present invention are also suitable in non-high temperature applications, such as in oil & gas exploration and production equipment. In one particular non-limiting embodiment in oil & gas exploration, the method of providing cermet linings, inserts and coatings of the present invention are used in sand screens where the outstanding erosion resistance to sand provides particular benefit. In another non-limiting embodiment in oil & gas exploration and production, the method of providing cermet linings, inserts and coatings of the present invention are used in oil sand (tar sands) mining process equipment applications where again the outstanding erosion resistance to sand provides particular benefit.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

The following example illustrates the present invention and the advantages thereto without limiting the scope thereof.

EXAMPLES

Illustrative Example 1

Figure 6:
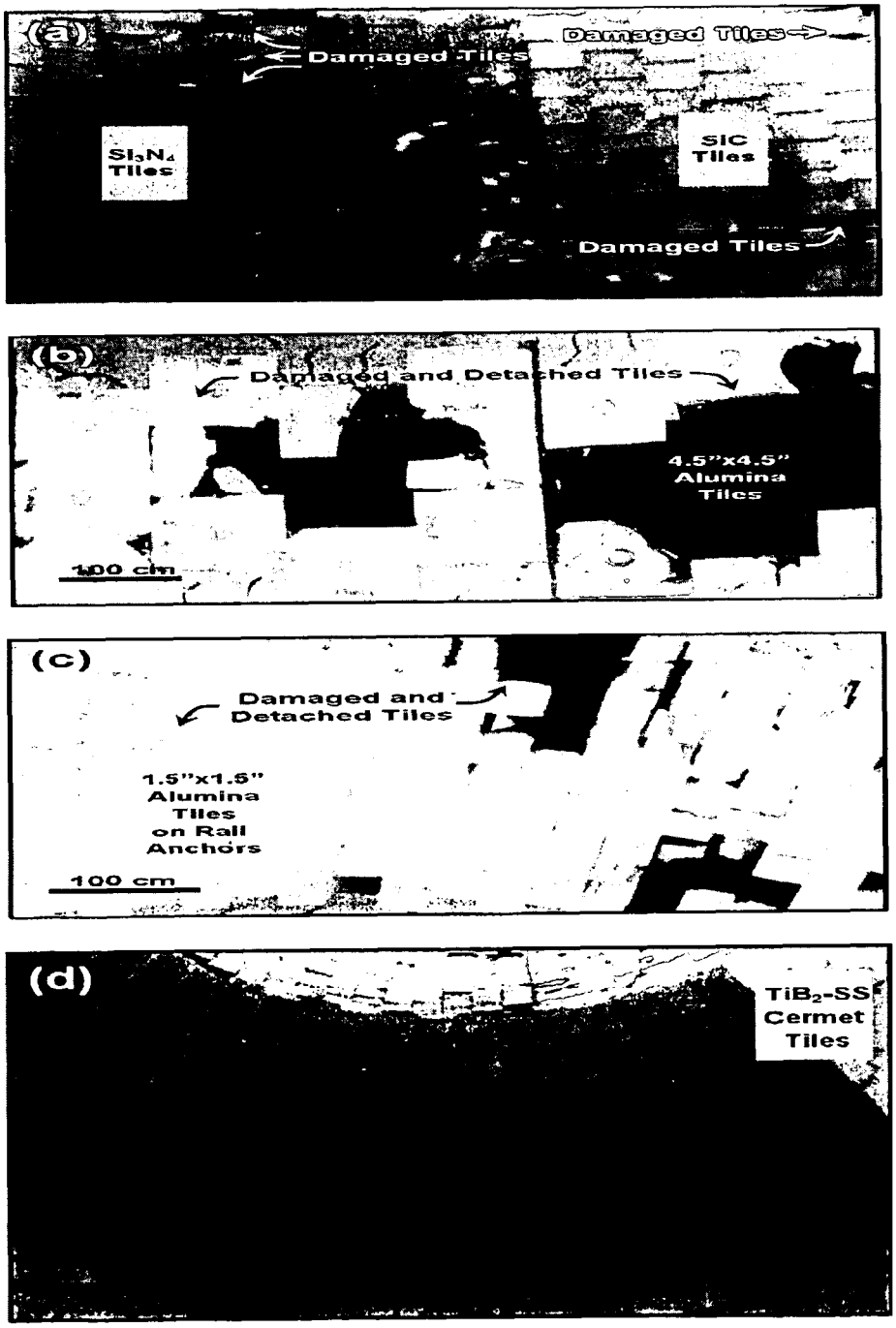
FIG. 6 depicts a comparison of the tile integrity of prior art ceramic ($Si_3N_4$, SiC and alumina) tiles [(a), (b), (c)] in comparison to the cermet tiles (d) of the present invention after 26 thermal cycles as a simulated cyclone liner.

The $TiB_2$ in stainless steel binder cermet of the present invention was tested experimentally as a liner in an actual cyclone drum or cylinder of an FCCU unit of a refinery. The liner was formed from tiles created by powder metallurgy processing attached via fusion welding of metal anchor to the inside wall of the cyclone. To provide a direct comparison with the prior art materials, sections of the cyclone liner or drum were also provided with $Si_3N_4$ tiles, SiC tiles, alumina tiles of 1½" square and alumina tiles of 4½" square. The cyclone drum was exposed to 26 thermal cycles with heat/cool rates from. The cyclone drum of FIG. 6 was exposed to 26 thermal cycles with heating/cooling rate severity of up to 500° F./hr (100° F./hour to 500° F./hour) in FCCU catalyst. The prior art $Si_3N_4$ and SiC lining tiles (FIG. 6(*a*)), and the prior art alumina lining tiles (FIG. 6(*b*) and (*c*)) all failed as exhibited by cracks in and missing tiles after exposure to 26 thermal cycles. In comparison, the $TiB_2$ in stainless steel binder cermet tiles of the present invention remained fully intact (FIG. 6(*d*)) after exposure to 26 thermal cycles. The cyclone cylinder or drum used in a refinery process depicted in FIG. 6 demonstrates the importance of toughness and better matched thermal expansion in the performance of cyclone linings.

Illustrative Example 2

Figure 7:
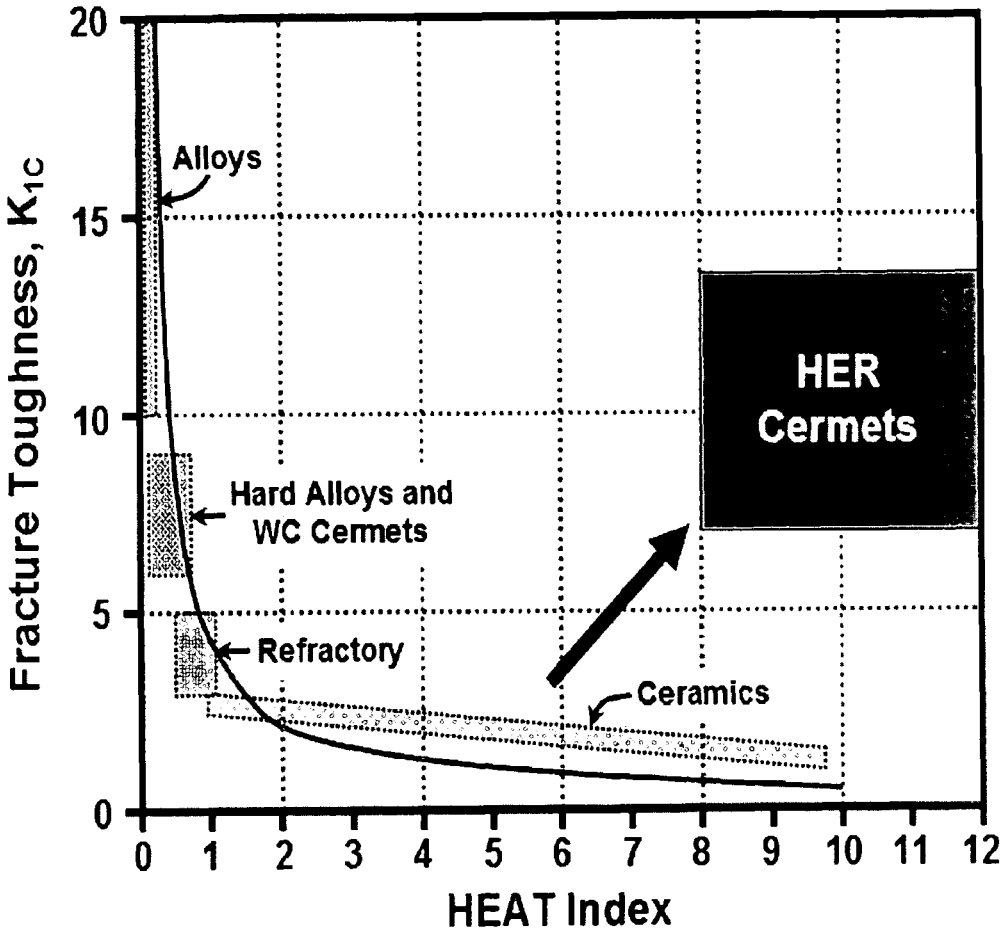
FIG. 7 depicts a plot of fracture toughness in MPa-$m^{1/2}$ as a function of HEAT erosion index for prior art refractories and ceramics in comparison to the hot erosion resistant (HER) cermets of the present invention.

The HER cermet linings and inserts of the present invention are suitable for many areas in refining and petrochemical processing units with temperatures in excess of 600° F. (316° C.) where FIG. 7 depicts a plot of HEAT determined erosion resistance (HEAT erosion resistance index) versus $K_1c$ fracture toughness (MPa-$m^{1/2}$) of a wide range of material candidates for high temperature linings using measured or published fracture toughness data for three point bending at room temperature. The plot exhibits that prior art materials (hard alloys and WC, refractories, and ceramics) follow the trend line showing the inverse relationship between fracture toughness and erosion resistance. That is a material with a high hot erosion resistance has poor fracture toughness and vice-versa. By comparison, data for the HER cermet linings of the present invention do not fall along the trend line, but are within a different regime considerably above the trend line (see "HER cermets" block area). This forms the basis for the advantageous use of such HER cermets in refinery and petrochemical processes where the combination of both outstanding fracture toughness and erosion resistance are beneficial. More particularly, HER cermet linings of the present invention displayed a fracture toughness from 7-13 MPa·$m^{1/2}$ tested for erosion resistance at 1350° F. (732° C.) using 60 μm particles (average) at 150 feet per second (45.7 m/sec) and compared to the best available refractory and ceramic materials (see "HER cermets" block area of FIG. 7). Test results for a cermet liner made of $TiB_2$ with a Type 304 stainless steel binder of the present invention displayed a 8-12 times higher erosion index than the best available castable refractory (see FIG. 7).

What is claimed is:

1. A method for protecting metal surfaces in oil & gas exploration and production, refinery and petrochemical process applications subject to solid particulate erosion at temperatures of up to 1000° C., the method comprising the step of providing said metal surfaces with a hot erosion resistant cermet lining or insert, wherein said cermet lining or insert comprises: a) a ceramic phase, and b) a metal binder phase, wherein said ceramic phase is (PQ) and said metal binder phase is (RS) wherein, P is at least one metal selected from the group consisting of Group IV, Group V, Group VI elements, Q is boride, R is selected from the group consisting of Fe, Ni, Co, Mn and mixtures thereof, and S comprises at least one element selected from the group consisting of Cr, Al, Si and Y wherein said ceramic phase comprises from about 30 to about 95 vol % of the volume of said cermet lining or insert, and wherein said cermet lining or insert has a HEAT erosion resistance index of at least about 5.0 and a $K_{1C}$ fracture toughness of at least about 7.0 MPa·$m^{1/2}$, wherein said cermet lining or insert is a composition gradient cermet material produced by the method comprising the steps of:

heating a metal alloy containing at least one of chromium and titanium at a temperature in the range of about 600° C. to about 1150° C. to form a heated metal alloy;

exposing said heated metal alloy to a reactive environment comprising at least one member selected from the group consisting of reactive carbon, reactive nitrogen, reactive boron, reactive oxygen and mixtures thereof in the range of about 600° C. to about 1150° C. for a time sufficient to provide a reacted alloy; and cooling said reacted alloy to a temperature below about 40° C. to provide a composition gradient cermet material.

2. The method of claim 1 wherein said hot erosion resistant cermet lining or insert is from about 5 millimeters to about 100 mm in overall thickness.

3. The method of claim 1 wherein said hot erosion resistant cermet lining or insert has a HEAT erosion resistance index of at least about 7.0 and a $K_1c$ fracture toughness of at least about 9.0 MPa·$m^{1/2}$.

4. The method of claim 3 wherein said hot erosion resistant cermet lining or insert has a HEAT erosion resistance index of at least about 10.0 and a $K_1c$ fracture toughness of at least about 11.0 MPa·$m^{1/2}$.

5. The method of claim 1 wherein said hot erosion resistant cermet lining or insert is used in areas of fluid catalytic conversion units, fluid cokers and flexicokers of refinery and petrochemical processes.

6. The method of claim 5 wherein said areas are selected from the group consisting of process vessels, transfer lines and process piping, heat exchangers, cyclones, slide valve gates and guides, feed nozzles, aeration nozzles, thermo wells, valve bodies, internal risers, deflection shields and combinations thereof.

7. The method of claim 1 wherein said hot erosion resistant cermet lining or insert is used in oil & gas exploration and production applications.

8. The method of claim 7 wherein said oil & gas exploration and production applications are sand screens or oil sand/tar sands mining equipment.

9. The method of claim 1 wherein said hot erosion resistant cermet lining comprise tiles formed by powder metallurgy processing.

10. The method of claim 9 wherein said tiles are in the shape of squares, rectangles, triangles, hexagons, octagons, pentagons, parallelograms, rhombus, circles or ellipses.

11. The method of claim 1 wherein R comprises at least 30 wt % Fe based on the weight of said metal binder phase (RS) and a metal selected from the group consisting of Ni, Co, Mn and mixtures thereof, and S further comprises Ti in the range of 0.1 to 3.0 wt % based on the weight of said metal binder phase (RS).

12. The method of claim 1 wherein said ceramic phase (PQ) has a multimodal distribution of particles, wherein said multimodal distribution of particles comprises fine grit particles in the size range of about 3 to 60 microns and coarse grit particles in the size range of about 61 to 800 microns.

13. The method of claim 12 wherein said multimodal distribution of particles comprises from about 40 vol % to about 50 vol % of said fine grit particles and about 50 vol % to about 60 vol % of said coarse grit particles.

14. The method of claim 1 wherein said metal alloy comprises from about 12 wt % to about 60 wt % chromium, and wherein said reacted alloy is a layer of about 1.5 mm to about 30 mm thickness on the surface or in the bulk matrix of said metal alloy.

15. A method for protecting metal surfaces in oil & gas exploration and production, refinery and petrochemical process applications subject to solid particulate erosion at temperatures of up to 1000° C., the method comprising the step of providing said metal surfaces with a hot erosion resistant cermet coating, wherein said cermet coating comprises: a) a ceramic phase, and b) a metal binder phase, wherein said ceramic phase is (PQ) and said metal binder phase is (RS) wherein, P is at least one metal selected from the group consisting of Group IV, Group V, Group VI elements, Q is boride, R is selected from the group consisting of Fe, Ni, Co, Mn and mixtures thereof, and S comprises at least one element selected from the group consisting of Cr, Al, Si and Y wherein said ceramic phase comprises from about 30 to about 95 vol % of the volume of said cermet coating, and wherein said cermet coating has a HEAT erosion resistance index of at least about 5.0, wherein said hot erosion resistant cermet coating is a composition gradient cermet material produced by the method comprising the steps of:

heating a metal alloy containing at least one of chromium and titanium at a temperature in the range of about 600° C. to about 1150° C. to form a heated metal alloy;

exposing said heated metal alloy to a reactive environment comprising at least one member selected from the group consisting of reactive carbon, reactive nitrogen, reactive boron, reactive oxygen and mixtures thereof in the range of about 600° C. to about 1150° C. for a time sufficient to provide a reacted alloy; and cooling said reacted alloy to a temperature below about 40° C. to provide a composition gradient cermet material.

16. The method of claim 15 wherein said hot erosion resistant cermet coating is from about 1 micron to about 5000 microns in overall thickness.

17. The method of claim 15 wherein said hot erosion resistant cermet coating has a HEAT erosion resistance index of at least about 7.0.

18. The method of claim 17 wherein said hot erosion resistant cermet coating has a HEAT erosion resistance index of at least about 10.0.

19. The method of claim 15 wherein said hot erosion resistant cermet coating is used in areas of fluid catalytic conversion units, fluid cokers and flexicokers of refinery and petrochemical processes.

20. The method of claim 19 wherein said areas are selected from the group consisting of process vessels, transfer lines and process piping, heat exchangers, cyclones, slide valve gates and guides, feed nozzles, aeration nozzles, thermo wells, valve bodies, internal risers, deflection shields and combinations thereof.

21. The method of claim 15 wherein said hot erosion resistant cermet coating is used in oil & gas exploration and production applications.

22. The method of claim 21 wherein said oil & gas exploration and production applications are sand screen or oil sand mining equipment.

23. The method of claim 15 wherein said hot erosion resistant cermet coating is formed by a thermal spray coating process.

24. The method of claim 23 wherein said thermal spray coating process is selected from the group consisting of plasma spray, combustion spray, arc spray, flame spray, high-velocity oxyfuel and detonation gun.

25. The method of claim 15 wherein R comprises at least 30 wt % Fe based on the weight of said metal binder phase (RS) and a metal selected from the group consisting of Ni, Co, Mn and mixtures thereof, and S further comprises Ti in the range of 0.1 to 3.0 wt % based on the weight of said metal binder phase (RS).

26. The method of claim 15 wherein said ceramic phase (PQ) has a multimodal distribution of particles, wherein said multimodal distribution of particles comprises fine grit particles in the size range of about 3 to 60 microns and coarse grit particles in the size range of about 61 to 800 microns.

27. The method of claim 26 wherein said multimodal distribution of particles comprises from about 40 vol % to about 50 vol % of said fine grit particles and about 50 vol % to about 60 vol % of said coarse grit particles.

28. The method of claim 15 wherein said metal alloy comprises from about 12 wt % to about 60 wt % chromium, and wherein said reacted alloy is a layer of about 1.5 mm to about 30 mm thickness on the surface or in the bulk matrix of said metal alloy.

* * * * *